US010474083B2

(12) United States Patent
Murakami

(10) Patent No.: US 10,474,083 B2
(45) Date of Patent: Nov. 12, 2019

(54) IMAGE FORMING APPARATUS

(71) Applicant: KONICA MINOLTA, INC., Chiyoda-ku, Tokyo (JP)

(72) Inventor: Daisuke Murakami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/205,585

(22) Filed: Nov. 30, 2018

(65) Prior Publication Data

US 2019/0212687 A1 Jul. 11, 2019

(30) Foreign Application Priority Data

Jan. 10, 2018 (JP) ..... 2018-001642

(51) Int. Cl.
*G03G 15/00* (2006.01)

(52) U.S. Cl.
CPC ..... *G03G 15/553* (2013.01); *G03G 15/5041* (2013.01); *G03G 15/5062* (2013.01)

(58) Field of Classification Search
CPC .. G03G 15/5062; G03G 15/55; G03G 15/553; G03G 15/556; G03G 2215/00042; G03G 2215/00067
See application file for complete search history.

(56) References Cited

U.S. PATENT DOCUMENTS

2007/0292146 A1 12/2007 Takesue et al.
2008/0075476 A1* 3/2008 Nakazato ..... G03G 15/55 399/15
2012/0057885 A1* 3/2012 Paul ..... G03G 15/0131 399/15

FOREIGN PATENT DOCUMENTS

JP 09230753 A * 9/1997
JP 2007334269 A 12/2007

OTHER PUBLICATIONS

Machine Translation of JP H09-230753. Sep. 5, 1997. (Year: 1997).*

* cited by examiner

*Primary Examiner* — Carla J Therrien
(74) *Attorney, Agent, or Firm* — Holtz, Holtz & Volek PC

(57) ABSTRACT

An image forming apparatus includes a causal member identifying section, and a judgement section. The causal member identifying section identifies the causal member as a cause of the periodic unevenness based on the period of the periodic unevenness which has been detected by the periodic unevenness detector. The judgement section judges whether or not the periodic unevenness is transient based on the information of the causal member identified by the causal member identifying section, the information of at least one of a resting time in which the image forming apparatus has been left inoperative, an operating time of the causal member, and the image forming condition for image formation, and the information of a temperature and a humidity inside the image forming apparatus.

11 Claims, 7 Drawing Sheets

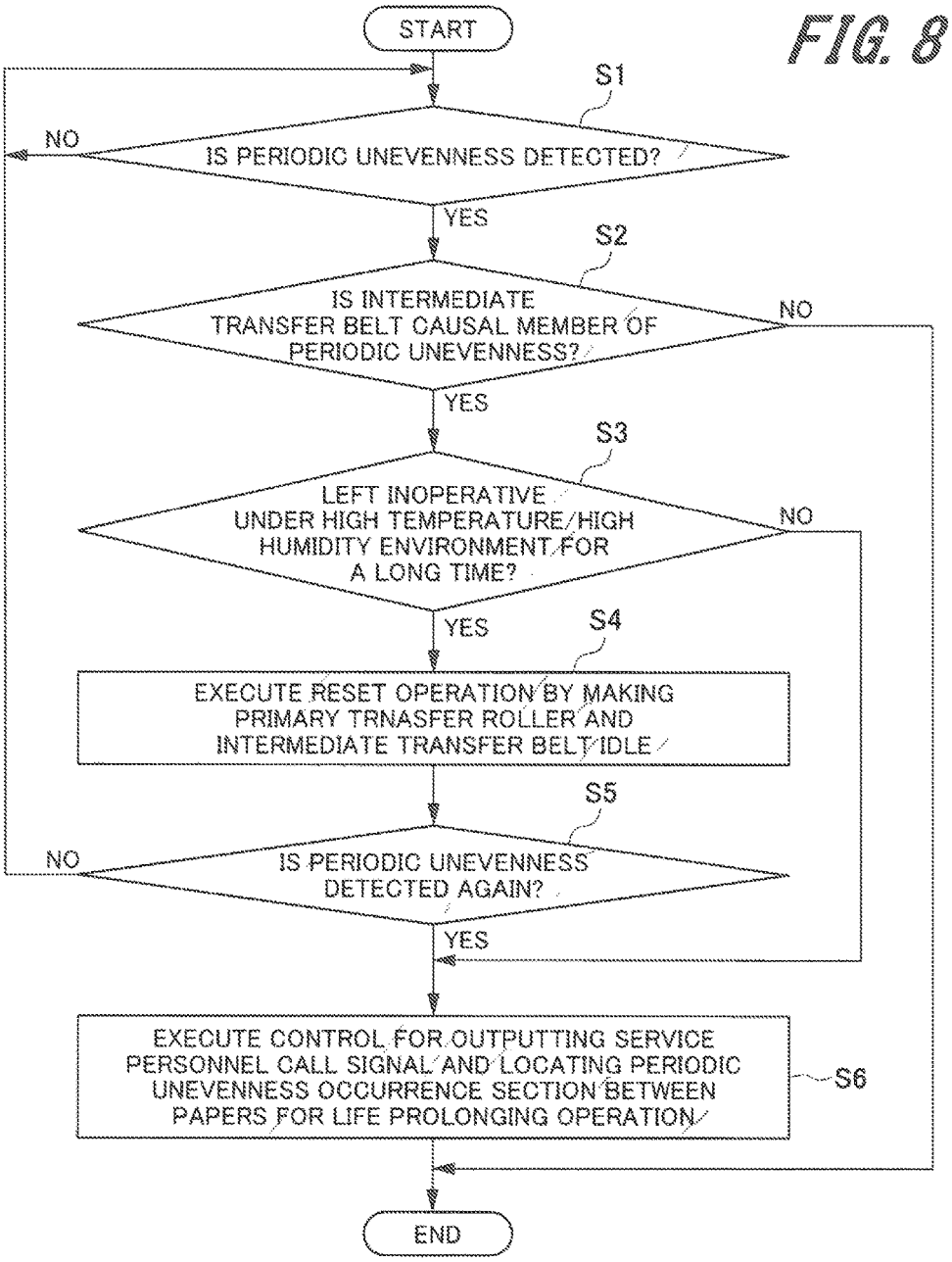
FIG. 8
START
S1
IS PERIODIC UNEVENNESS DETECTED?
NO
YES
S2
IS INTERMEDIATE TRANSFER BELT CAUSAL MEMBER OF PERIODIC UNEVENNESS?
NO
YES
S3
LEFT INOPERATIVE UNDER HIGH TEMPERATURE/HIGH HUMIDITY ENVIRONMENT FOR A LONG TIME?
NO
YES
S4
EXECUTE RESET OPERATION BY MAKING PRIMARY TRNASFER ROLLER AND INTERMEDIATE TRANSFER BELT IDLE
S5
IS PERIODIC UNEVENNESS DETECTED AGAIN?
NO
YES
EXECUTE CONTROL FOR OUTPUTTING SERVICE PERSONNEL CALL SIGNAL AND LOCATING PERIODIC UNEVENNESS OCCURRENCE SECTION BETWEEN PAPERS FOR LIFE PROLONGING OPERATION
S6
END

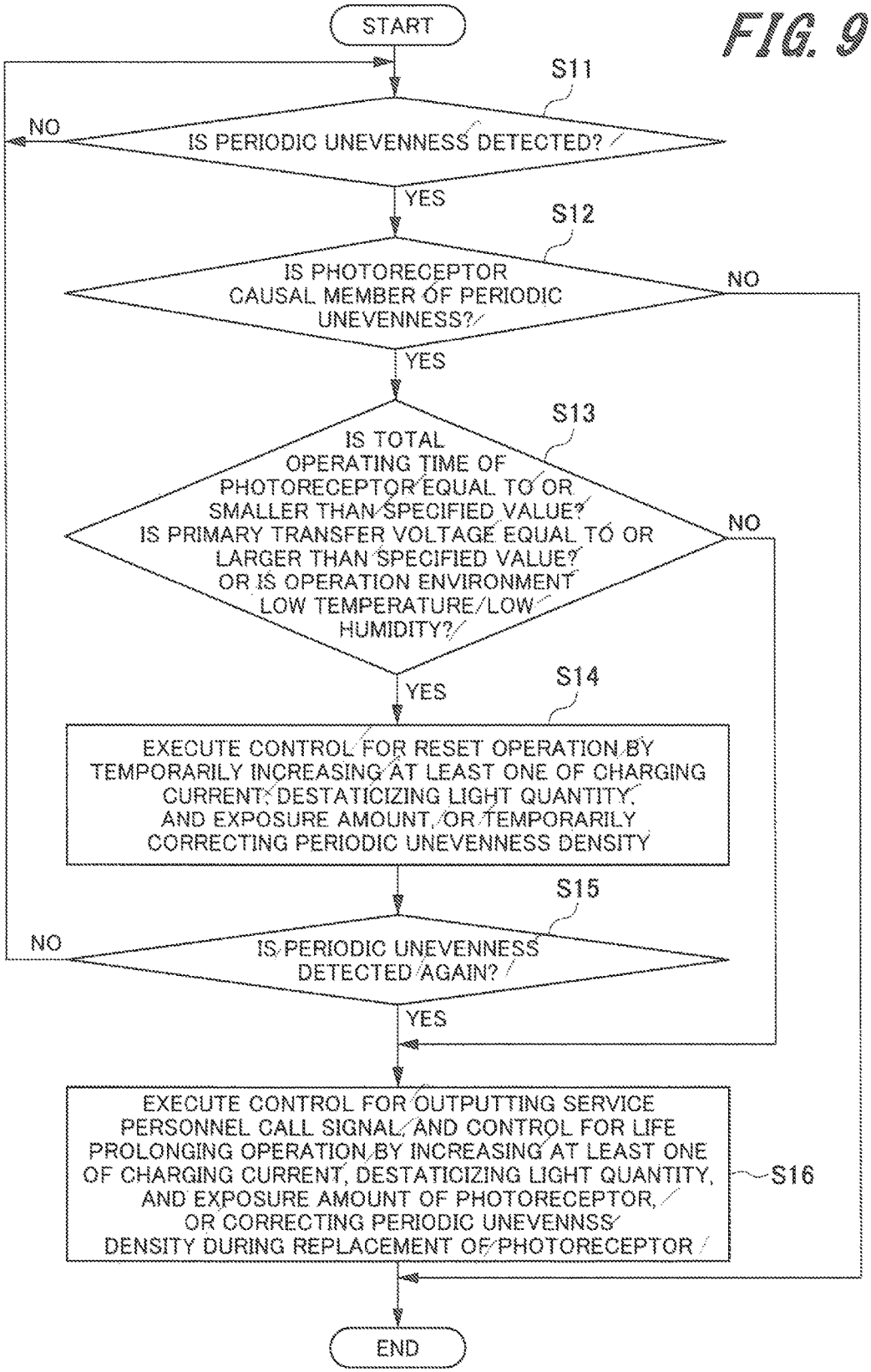
FIG. 9
START
S11
IS PERIODIC UNEVENNESS DETECTED?
NO
YES
S12
IS PHOTORECEPTOR CAUSAL MEMBER OF PERIODIC UNEVENNESS?
NO
YES
S13
IS TOTAL OPERATING TIME OF PHOTORECEPTOR EQUAL TO OR SMALLER THAN SPECIFIED VALUE? IS PRIMARY TRANSFER VOLTAGE EQUAL TO OR LARGER THAN SPECIFIED VALUE? OR IS OPERATION ENVIRONMENT LOW TEMPERATURE/LOW HUMIDITY?
NO
YES
S14
EXECUTE CONTROL FOR RESET OPERATION BY TEMPORARILY INCREASING AT LEAST ONE OF CHARGING CURRENT, DESTATICIZING LIGHT QUANTITY, AND EXPOSURE AMOUNT, OR TEMPORARILY CORRECTING PERIODIC UNEVENNESS DENSITY
S15
IS PERIODIC UNEVENNESS DETECTED AGAIN?
NO
YES
EXECUTE CONTROL FOR OUTPUTTING SERVICE PERSONNEL CALL SIGNAL, AND CONTROL FOR LIFE PROLONGING OPERATION BY INCREASING AT LEAST ONE OF CHARGING CURRENT, DESTATICIZING LIGHT QUANTITY, AND EXPOSURE AMOUNT OF PHOTORECEPTOR, OR CORRECTING PERIODIC UNEVENNSS DENSITY DURING REPLACEMENT OF PHOTORECEPTOR
S16
END

IMAGE FORMING APPARATUS

CROSS-REFERENCE TO RELATED APPLICATIONS

The entire disclosure of Japanese Patent Application No. 2018-1642, filed on Jan. 10, 2018, is incorporated herein by reference in its entirety.

BACKGROUND

Technological Field

The present invention relates to an image forming apparatus.

Description of the Related Art

In the case of failure or deterioration in the rotary member such as a roller, a belt, and a photoreceptor used for the image forming apparatus of electrophotographic type for image formation, there may often be the case that an image on the printed matter has a periodic density unevenness (hereinafter referred to as "periodic unevenness"). If the above-described periodic unevenness occurs, the rotary member as the cause of the periodic unevenness will be replaced by the service personnel. While the service personnel is working on replacement of the rotary member, the user cannot use the image forming apparatus until completion of the replacement, resulting in the downtime.

Patent Literature 1 discloses the image forming apparatus including the state determination unit for determining the state of the apparatus based on the calculated deviation amount of the image data from those in the normal state, the abnormality identifying unit for identifying the abnormal point in reference to the state of the apparatus, and the image processing unit that executes the image processing for correcting the abnormality in accordance with the output from the abnormality identifying unit. The disclosed image forming apparatus further includes the service personnel call output unit for outputting the service personnel call signal if the abnormality is determined by the state determination unit.

The image forming apparatus disclosed in Patent Literature 1 is configured to allow the image processing unit to execute the image processing for correcting the abnormality by adjusting the tone curve while increasing or decreasing the supply amount of the toner for each color so that the density is brought into the normal state where the gray balance is retained. According to the technology in Patent literature 1, the image forming apparatus is capable of reducing the downtime which prevents the user from operating the image forming apparatus.

SUMMARY

The periodic unevenness may occur transiently, which is restorable without replacing the member as the cause of the periodic unevenness. However, the technology disclosed in Patent Literature 1 is configured to output the service personnel call signal at all times in response to the periodic unevenness without judging whether or not such periodic unevenness is transient. Such technology may fail to prevent the wasted replacement of the member that needs not be replaced, leading to unnecessary cost increase.

The present invention has been made to solve the above problem. It is an object of the present invention to provide the image forming apparatus capable of judging whether or not the periodic unevenness is transient.

To achieve at least one of the abovementioned objects, the image forming apparatus reflecting one aspect of the present invention includes a density sensor, a periodic unevenness detector, a causal member identifying section, and a judgement section. The density sensor measures a density of an image formed on a paper or a toner deposition amount, and outputs a measured value. The periodic unevenness detector detects a periodic unevenness as a density unevenness which periodically appears on the image in a carrying direction of the paper, and calculates a period of the periodic unevenness based on the image density or the toner deposition amount output from the density sensor. The causal member identifying section identifies a causal member as a cause of the periodic unevenness based on the period of the periodic unevenness detected by the periodic unevenness detector. The judgement section judges whether or not the periodic unevenness is transient based on information of the causal member identified by the causal member identifying section, information of at least one of a resting time in which the image forming apparatus has been left inoperative, an operating time of the causal member, and an image forming condition for forming the image, and information of a temperature and a humidity inside the image forming apparatus.

The present invention provides the image forming apparatus capable of judging whether or not the periodic unevenness is transient.

BRIEF DESCRIPTION OF THE DRAWINGS

The advantages and features provided by one or more embodiments of the present invention will become more fully understood from the detailed description given hereinbelow and the attached drawings. It is to be expressly understood, however, that the drawings are given for purpose of illustration and exemplification only and are not intended as a definition of the limits of the present invention.

FIG. 8 is a flowchart representing a processing procedure executed in the image forming apparatus according to a first example of the embodiment of the present invention; and FIG. 9 is a flowchart representing a processing procedure executed in the image forming apparatus according to a second example of the embodiment of the present invention.

DETAILED DESCRIPTION OF EMBODIMENTS

Figure 1:
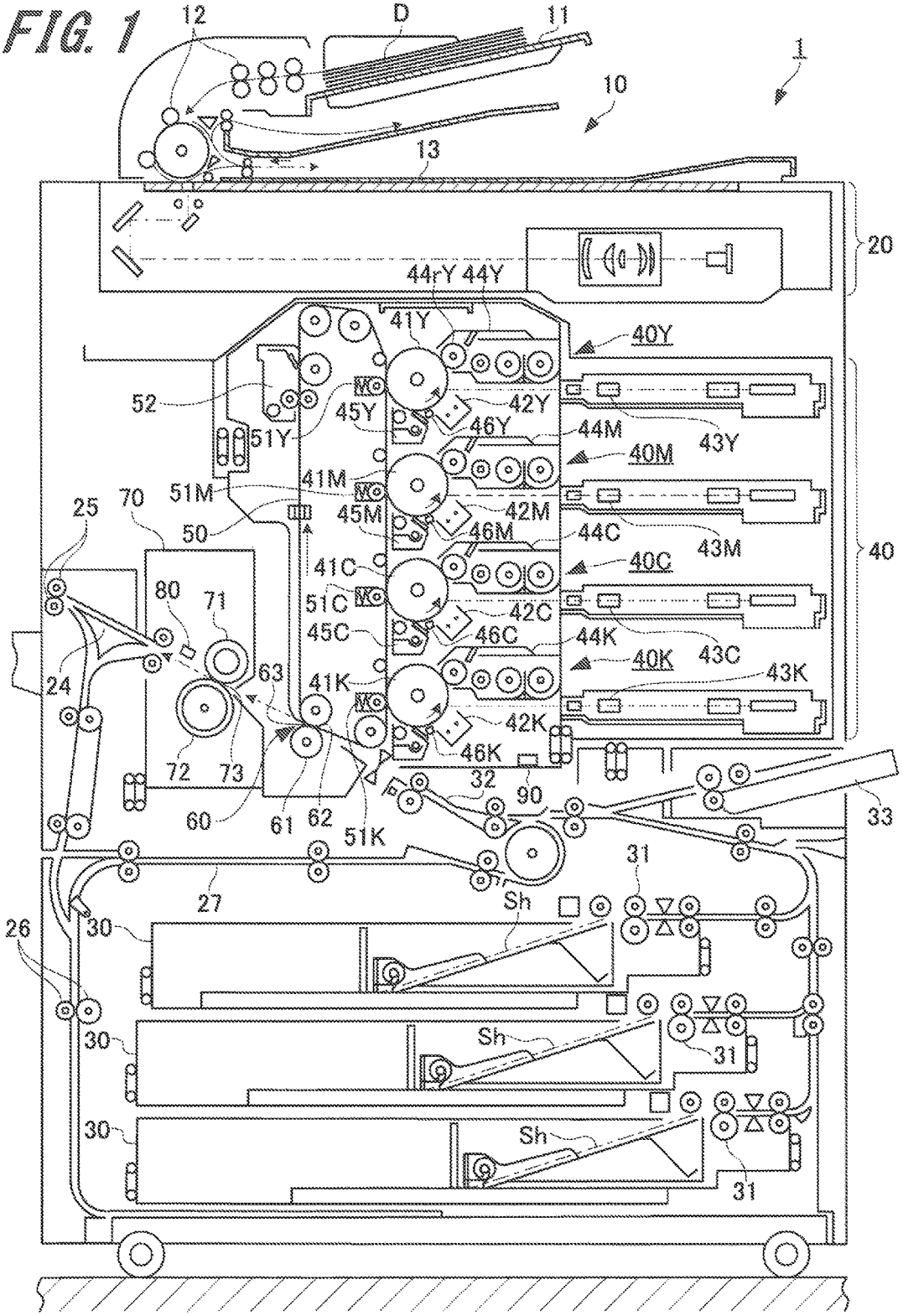
FIG. 1 is a schematic view illustrating an exemplary overall structure of an image forming apparatus according to an embodiment of the present invention.

The image forming apparatus according to one or more embodiments of the present invention will be described referring to the drawings. However, the scope of the invention is not limited to the disclosed embodiments. Components as described in the specification and the drawings, which have substantially the same functions or the same structures will be designated with the same codes, and explanations thereof, thus will be omitted.

<Overall Structure of Image Forming Apparatus>

The overall structure of the image forming apparatus according to an embodiment of the present invention will be described referring to FIG. 1. FIG. 1 is a schematic view illustrating an exemplary overall structure of an image forming apparatus 1 according to an embodiment of the present invention.

As FIG. 1 shows, the image forming apparatus 1 according to the embodiment of electrophotographic type forms an image on a paper Sh using static electricity while having 4 color toners of yellow (Y), magenta (M), cyan (C), and black (K) superposed in tandem. The image forming apparatus 1 includes a document carrier 10, an image reader 20, a paper storage section 30, an image forming section 40, an intermediate transfer belt 50, a secondary transfer section 60, a fixing section 70, a density sensor 80, and a thermometer/hygrometer 90.

The document carrier 10 includes a document feeding stand 11 on which a document Dr is set, and a plurality of rollers 12. The document Dr set on the document feeding stand 11 of the document carrier 10 will be carried by the rollers 12 to a reader position (not shown) on the image reader 20 one by one. The image reader 20 reads the image of the document Dr carried by the document carrier 10, or the image of the document Dr set on a document table 13 for generating an image signal.

The paper storage section 30 is a tray for storing the paper Sh, and disposed at the lower part of a main body of the image forming apparatus 1. A plurality of paper storage sections 30 may be disposed corresponding to the respective sizes of the papers Sh. FIG. 1 shows the 3 paper storage sections 30, for example.

A paper feed section 31 is disposed around the paper storage section 30. The paper feed section 31 feeds the paper Sh stored in the paper storage section 30 to a carrier section 32 as the carrier path for carrying the paper Sh. The carrier section 32 carries the paper Sh fed by the paper feed section 31 toward the secondary transfer section 60.

A manual feed unit 33 is disposed around the paper storage section 30. The paper with size other than those stored in the paper storage sections 30, the tag paper with the tag, and the special paper such as the OHP sheet will be inserted into the manual feed unit 33.

The image forming section 40 and the intermediate transfer belt 50 are disposed between the paper storage sections 30 and the image reader 20. The image forming section 40 includes image forming units 40Y, 40M, 40C, 40K for forming toner images of the respective colors Y, M, C, and K.

The image forming unit 40Y forms the yellow toner image, and the image forming unit 40M forms the magenta toner image. The image forming unit 40C forms the cyan toner image, and the image forming unit 40K forms the black toner image. Each of those image forming units 40 has the same structure. Therefore the structure of the image forming unit 40Y will be exemplified as described below.

The image forming unit 40Y includes a drum-like photoreceptor 41Y as an image carrier, a charging part 42Y disposed around the photoreceptor 41Y, an exposure part 43Y, a developing part 44Y, a cleaning part 45Y, and a destaticizing part 46Y.

Driven by a not shown drive motor, the photoreceptor 41Y is rotated counterclockwise. The charging part 42Y applies an electrical charge to the photoreceptor 41Y so as to have its surface uniformly charged. The exposure part 43Y performs exposure scanning on the surface of the photoreceptor 41Y based on the image data generated by the image reader 20 so that the electrostatic latent image is formed on the photoreceptor 41Y. The developing part 44Y includes a developing roller 44*r*Y. As the developing roller 44*r*Y rotates, the toner adhering onto the surface of the developing roller 44*r*Y together with iron powder is stuck onto the electrostatic latent image formed on the photoreceptor 41Y. As a result, the toner image is formed on the surface of the photoreceptor 41Y.

The intermediate transfer belt 50 of endless type is wound around a plurality of rollers. The outer circumferential surface of the intermediate transfer belt 50 is brought into contact with the respective outer circumferences of the photoreceptors 41Y, 41M, 41C, 41K. Driven by the not shown drive motor, the intermediate transfer belt 50 is rotated clockwise opposite to the rotating directions of the photoreceptors 41Y, 41M, 41C, 41K. In the case where the photoreceptors 41Y, 41M, 41C, 41K do not have to be individually distinguished, they will be collectively referred to as "photoreceptors 41" in the following description.

Primary transfer rollers 51Y, 51M, 51C, 51K are disposed on the inner circumferential surface of the intermediate transfer belt 50 at positions corresponding to those in contact with the photoreceptors 41Y, 41M, 41C, 41K, respectively. Each of the primary transfer rollers 51Y, 51M, 51C, 51K applies the voltage (primary transfer voltage) with polarity opposite to the polarity of the toner to the intermediate transfer belt 50 so that the toner images formed on the photoreceptors 41Y, 41M, 41C, 41K are transferred onto the intermediate transfer belt 50. In the case where the primary transfer rollers 51Y, 51M, 51C, 51K do not have to be individually distinguished, they will be collectively referred to as "primary transfer rollers 51" in the following description.

As the intermediate transfer belt 50 rotates, the toner images formed by the respective image forming units 40Y to 40K are sequentially transferred onto the surface of the intermediate transfer belt 50. The yellow, magenta, cyan, and black toner images are superposed on the intermediate transfer belt 50 to form the color toner image thereon.

After transferring the image onto the intermediate transfer belt 50, the cleaning part 45Y removes the toner remaining on the surface of the photoreceptor 41Y. The destaticizing part 46Y irradiates the surface of the photoreceptor 41Y with light to erase the charge remaining on the surface of the photoreceptor 41Y after transferring the image onto the intermediate transfer belt 50.

On the intermediate transfer belt 50, the secondary transfer section 60 is disposed downstream of the part in contact with the photoreceptor 41K. The secondary transfer section 60 includes a secondary transfer roller 61 and a secondary transfer counter roller 62, both of which are in pressure contact with each other via the intermediate transfer belt 50. A secondary transfer nip part 63 is formed at the part where the secondary transfer roller 61 and the secondary transfer counter roller 62 are in pressure contact with each other.

The paper Sh carried by the carrier section 32 passes through the secondary transfer nip part 63 so that the toner image formed on the outer circumferential surface of the intermediate transfer belt 50 is transferred onto the paper Sh. That is, the secondary transfer nip part 63 is located at the transfer position where the toner image formed by the image forming section is transferred onto the paper Sh.

On the intermediate transfer belt 50, a belt cleaning part 52 is disposed downstream of the part at which the secondary transfer nip part 63 is formed. The belt cleaning part 52 cleans the surface of the intermediate transfer belt 50 to remove the toner remaining on the belt surface after transferring the toner image onto the paper Sh.

The fixing section 70 is disposed at the position downstream of the secondary transfer section 60 in the direction for carrying the paper Sh. The fixing section 70 includes an upper fixing roller 71 and a lower fixing roller 72. The upper fixing roller 71 and the lower fixing roller 72 are disposed while being in pressure contact with each other. A fixing nip part 73 is formed at the part where the upper fixing roller 71 and the lower fixing roller 72 are in contact. The paper Sh is carried toward the fixing nip part 73 so that the paper surface (fixed surface) onto which the toner image is transferred by the secondary transfer section 60 faces the upper fixing roller 71. As the paper Sh passes through the fixing nip part 73, the upper fixing roller 71 and the lower fixing roller 72 apply pressure to the paper Sh.

A heater (not shown) is disposed at an inner side of the upper fixing roller 71. The roller part at the outer circumference of the upper fixing roller 71 is warmed by radiant heat emitted from the heater. As the paper Sh passes through the fixing nip part 73, the heat of the roller part of the upper fixing roller 71 is transferred to the paper Sh.

As described above, the paper Sh passing through the fixing nip part 73 is pressurized by the upper fixing roller 71 and the lower fixing roller 72, and heated by the roller part of the fixing upper roller 71 so that the toner image transferred from the intermediate transfer belt 50 is fixed on the paper Sh.

The density sensor 80, a switching gate 24, and a pair of paper discharge rollers 25 are disposed downstream of the fixing section 70 in the direction for carrying the paper Sh. A paper reversing carrier unit 26 is disposed below the selector gate 24.

The density sensor 80 disposed on the carrier path for the paper Sh measures the density of the image formed on the paper Sh to be carried on the carrier path. The density sensor 80 includes a light source, for example, a tungsten halogen lamp for lighting the paper Sh. The intensity of the light reflecting from the paper Sh is measured, based on which the reflection absolute density D is calculated. The reflection absolute density D is calculated using the following formula (1). The term "R" in the formula (1) denotes the reflectance.

$$\text{Reflection absolute density } D = -\log_{10}(R) \qquad \text{formula (1)}$$

In the embodiment, the density sensor 80 calculates the reflection absolute density D as the image density. The present invention, however, is not limited to the one as described above. The density sensor 80 may be configured to calculate the amount of the toner deposited on the paper Sh as the image density.

The switching gate 24 switches the carrier path for the paper Sh passing through the fixing section 70. Specifically, upon execution of the face-up paper discharge in the one-side image forming process, the switching gate 24 allows the paper Sh to be carried toward the pair of paper discharge rollers 25 straightforward. The paper Sh is discharged outside the image forming apparatus 1 by the paper discharge roller pair 25.

Upon execution of the face-down paper discharge in the one-side image formation, or the double-side image formation, the switching gate 24 guides the paper Sh toward (downward in the drawing) the paper reversing carrier unit 26. The paper reversing carrier unit 26 reverses the incoming paper Sh inside out so that the reversed paper Sh is output in the direction (upward in the drawing) in which the paper Sh has been carried. The paper Sh which has been reversed inside out and output from the paper reversing carrier unit 26 is carried on a paper re-feeding path 27 that connects the paper reversing carrier unit 26 and the transfer position. The paper is then fed to the transfer position again.

It is also possible to dispose a post-processing device at the downstream side of the pair of paper discharge rollers 25 for folding or stapling the paper Sh, for example.

The thermometer/hygrometer 90 is disposed around the position at which the image forming unit 40K is disposed in the center part of the image forming apparatus 1. The thermometer/hygrometer 90 measures the temperature and humidity inside the image forming apparatus 1, and outputs the information of the temperature and humidity to a controller 100 to be described later.

<Structure of Control System for Image Forming Apparatus>

Figure 2:
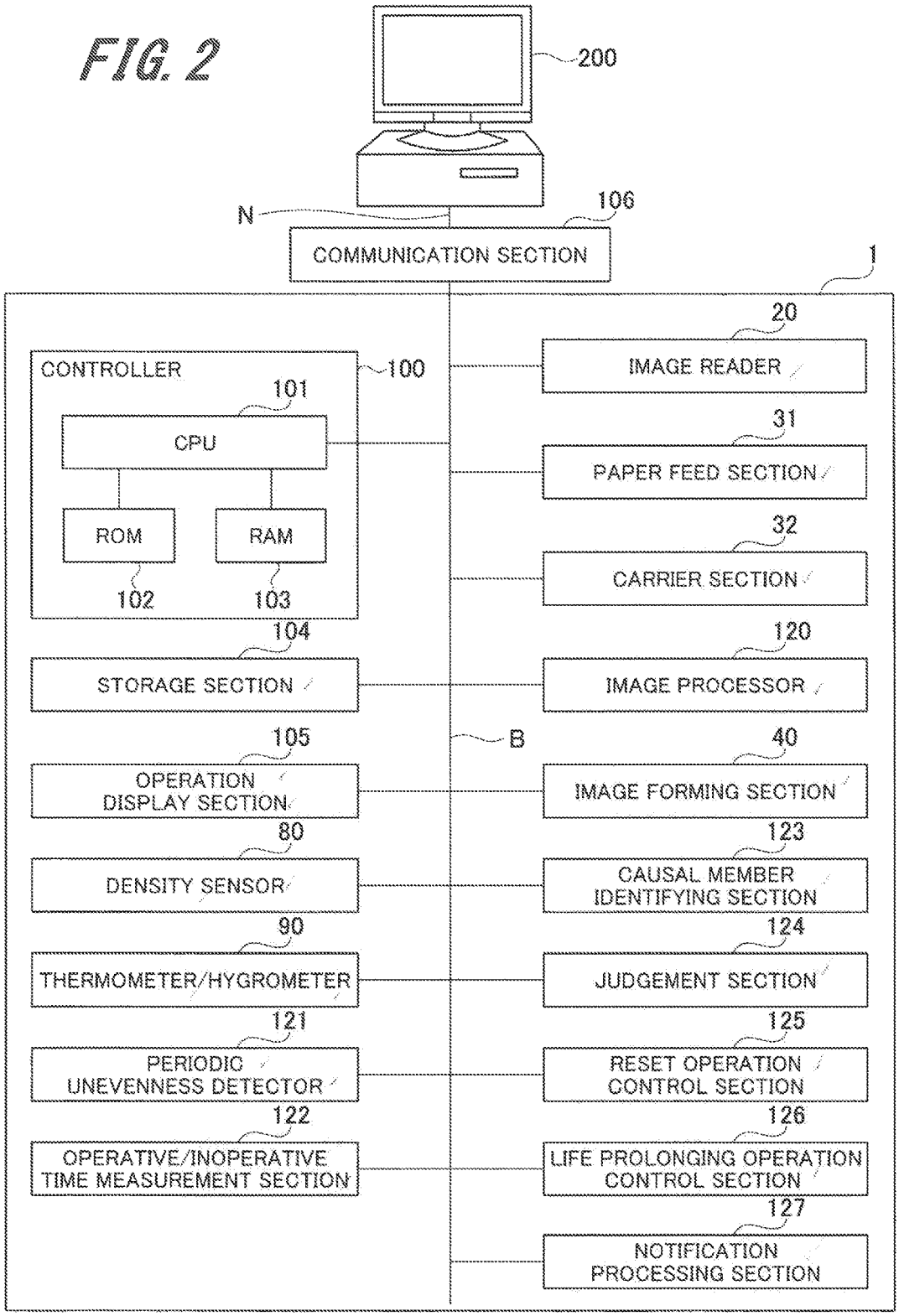
FIG. 2 is a block diagram of an exemplary structure of a control system for the image forming apparatus according to an embodiment of the present invention.

An explanation will be made with respect to structure of a control system for the image forming apparatus 1 referring to FIG. 2. FIG. 2 is a block diagram showing an exemplary structure of the control system for the image forming apparatus 1.

As FIG. 2 shows, the image forming apparatus 1 includes the controller 100. The controller 100 includes, for example, a CPU (Central Processing Unit) 101, a ROM (Read Only Memory) 102 for storing the program executed by the CPU 101, and a RAM (Random Access Memory) 103 used as the working area for the CPU 101.

The CPU 101 is connected to the image reader 20, the paper feed section 31, the carrier section 32, an image processor 120, and the image forming section 40, respectively via a system bus B. The CPU 101 communicates with those components connected via the system bus B for controlling operations of the respective components.

Specifically, the CPU 101 controls the paper feed section 31 to feed the paper Sh from the paper storage section 30 (see FIG. 1), for example. The CPU 101 controls the carrier section 32 to carry the fed paper Sh toward the transfer position.

The CPU 101 controls the image reader 20, for example, to read the document Dr set on the document feeding stand 11 (see FIG. 1), and further to generate image data corresponding to the read image.

The CPU 101 controls operations of the image processor 120. Under the control of the CPU 101, the image processor 120 executes various types of image processing with respect to the image data generated by the image reader 20, and the image data sent from a PC 200 connected to the image forming apparatus 1 via a communication section 106 and a communication line N. Specifically, the image processor 120 executes such process as analog processing, A/D conversion, shading correction, image compression, and periodic unevenness (periodic density unevenness of the image) correction.

The CPU 101 executes drive control of the image forming section 40 so as to form the toner image for image formation, or image density control on the photoreceptor 41, and to perform the primary transfer of the toner image onto the intermediate transfer belt 50 (see FIG. 1). The CPU 101 executes drive control of the secondary transfer section 60 (see FIG. 1) to secondarily transfer the toner image carried by the intermediate transfer belt 50 onto the paper Sh. The CPU 101 further executes drive control of the fixing section 70 to pressurize and heat the paper Sh on which the toner image is fixed.

The CPU 101 is connected to a storage section 104, an operation display section 105, the communication section 106, the density sensor 80, and the thermometer/hygrometer 90 via the system bus B. The CPU 101 communicates with the above-described components connected via the system bus B for controlling operations of the respective components.

The storage section 104 stores the image data of the document image read by the image reader 20, and the image data which have been already output. The storage section 104 serves to hold various data to be used for the judgement process executed by a judgement section 124 to be described later. The various holding units inside the storage section 104 will be described later referring to FIG. 3.

The operation display section 105 is a touch panel integrally constituted by such a display as a liquid crystal display (LCD) device and an organic ELD (Electro Luminescence Display), and a touch sensor. The operation display section 105 displays an instruction menu for the user, and information of the acquired image data under the control of the CPU 101. The operation display section 105 receives inputs of various instructions, and data such as characters and figures through the user's operation, and outputs an input signal to the controller 100.

The communication section 106 receives a job sent from the PC (Personal Computer) 200 as an external device via the communication line N, and transmits the received job to the controller 100 via the system bus B. The job includes image data of an image to be formed, and information about the paper type and the number of papers for use, which are corresponded to the image data.

In the embodiment, the personal computer is employed as the external device without being limited thereto. It is also possible to employ the device of arbitrary type as the external device, for example, facsimile machine and the like.

As the density sensor 80 and the thermometer/hygrometer 90 have already been explained referring to FIG. 1, explanations of those components will be omitted.

The CPU 101 is connected to a periodic unevenness detector 121, an operative/inoperative time measurement section 122, a causal member identifying section 123, a judgement section 124, a reset operation control section 125, a life prolonging operation control section 126, and a notification processing section 127 via the system bus B. The CPU 101 communicates with those connected via the system bus B for controlling operations of the respective sections.

The periodic unevenness detector 121 executes frequency analysis of the image density input from the density sensor 80 for converting the image density into the waveform information. The periodic unevenness detector 121 detects a large amplitude part of the obtained waveform, that is, the region with a large density variation value to calculate the detection period (frequency or distance interval).

As described above, the density sensor 80 measures the density of the image formed on the paper Sh carried on the carrier path. Therefore, in the case where the periodic unevenness detector 121 detects the region with a large density variation value in the fixed period, it may be thought that the periodic density unevenness has occurred in the direction for carrying the image formed on the paper Sh. In other words, the period in which the region with a large density variation value is detected represents the periodic unevenness period. It is possible to set the threshold value for detecting the region with a large density variation value as the "value (density) estimated from the image data input for printing in the range of ±0.1", for example. The process executed by the periodic unevenness detector 121 will be described in detail later referring to FIG. 4.

The operative/inoperative time measurement section 122 measures the operating time of the photoreceptor 41, and the resting time in which the image forming apparatus 1 is left inoperative (hereinafter referred to as "inoperative time"). The operative/inoperative time measurement section 122 may be configured to measure the operating time of each rotary member called function member in addition to the operating time of the photoreceptor 41. The function member is highly likely to influence quality of the image on the printed matter, and cause the periodic unevenness. The function member includes the developing roller **44*r*, the photoreceptor 41, the intermediate transfer belt 50, the primary transfer roller 51, the secondary transfer roller 61, the secondary transfer counter roller 62, the secondary transfer belt (not shown), the fixing upper roller 71, and the fixing lower roller 72**.

The causal member identifying section 123 identifies the rotary member indicated below (1), (2), or (3) as the member as the cause of the periodic unevenness (hereinafter referred to as the "causal member").

(1) Rotary member with the same rotation period as the periodic unevenness period;

(2) Rotary member that rotates at the same frequency as that of the periodic unevenness; or (3) Rotary member with the same circumferential length as the distance interval at which the periodic unevenness appears.

Based on the information of the causal member identified by the causal member identifying section 123, the information of at least one of the resting time of the image forming apparatus 1, the operating time of the causal member (photoreceptor 41), and the image forming condition, and the information of the temperature and humidity inside the image forming apparatus, the judgement section 124 judges whether or not the periodic unevenness detected by the periodic unevenness detector 121 is transient. The information of the image forming condition refers to the value of the primary transfer voltage applied by the primary transfer roller 51.

If the judgement section 124 judges that the periodic unevenness detected by the periodic unevenness detector 121 is transient, the reset operation control section 125 executes the control for reset operation to rectify the transient periodic unevenness of the subject member.

If the control for reset operation is not executed by the judgment section 124, or the periodic unevenness is not rectified by the reset operation controlled by the reset operation control section 125, the life prolonging control section 126 executes the control so that the notification processing section 127 outputs the service personnel call signal. The life prolonging operation control section 126 then executes the control for prolonging the life of the subject member to rectify the periodic unevenness. If the life prolonging control is executed, the life prolonging operation control section 126 allows the notification processing section 127 to notify the manager of the information that the time for replacing the component needed to have its life prolonged is approaching. The process to be executed by the reset operation control section 125 and the life prolonging operation control section 126 will be described in the first and the second examples later.

Under the control of the life prolonging operation control section 126, the notification processing section 127 outputs the service personnel call signal to the user and the manager, and notifies the manager of the present state that the time for replacing the component subjected to the life prolonging operation is approaching.

[Example of Various Holding Units Formed in the Storage Section]

Figure 3:
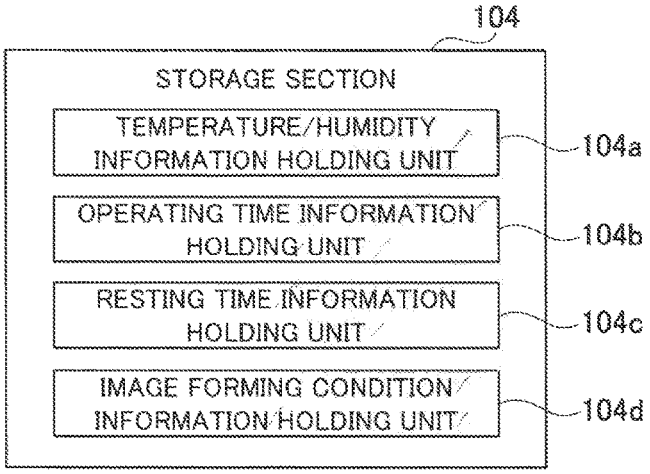
FIG. 3 is an explanatory view of an example of various holding units of a storage section according to an embodiment of the present invention.

An example of various types of holding units of the storage section 104 will be described referring to FIG. 3. FIG. 3 is an explanatory view showing an example of various types of holding units of the storage section 104.

As FIG. 3 shows, the storage section 104 includes a temperature/humidity information holding unit 104*a*, an operating time information holding unit 104*b*, a resting time information holding unit 104*c*, and an image forming condition information holding unit 104*d*. The temperature/humidity information holding unit 104*a* stores the information of the temperature and humidity inside the image forming apparatus 1, which have been measured by the thermometer/hygrometer 90 (see FIG. 1). The operating time information holding unit 104*b* stores the operating time information of the photoreceptor 41 (and the respective rotary members called function members), which has been measured by the operative/inoperative time measurement section 122.

The resting time information holding unit 104*c* stores the information of the resting time of the image forming apparatus 1, which has been measured by the operative/inoperative time measurement section 122. The image forming condition information holding unit 104*d* stores the value of the primary transfer voltage as the voltage to be applied to the intermediate transfer belt 50 by the primary transfer roller 51. The primary transfer voltage is measured by the not shown voltage detection sensor.

[Example of Periodic Unevenness Detection Process Executed by Periodic Unevenness Detector]

Figure 4:
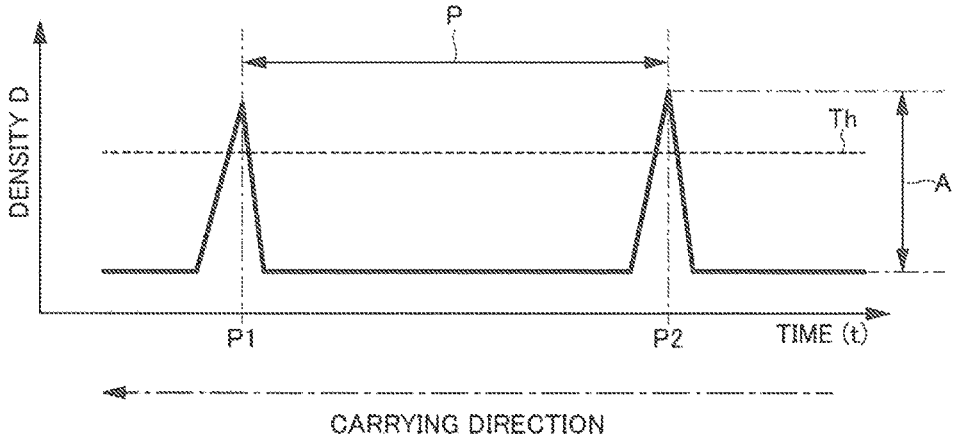
FIG. 4 is a graph showing an example of density variation in the state where the periodic unevenness occurs according to an embodiment of the present invention.

An example of the periodic unevenness detection process executed by the periodic unevenness detector 121 will be described referring to FIG. 4. FIG. 4 is a graph showing an example of variation in the density in the state where the periodic unevenness appears. The y-axis of the graph denotes the reflection absolute density D, and the x-axis denotes the time (t). The x-axis of the graph shown in FIG. 4 may be regarded as the position of the paper Sh carried at the predetermined carrying speed in the carrying direction. The carrying direction is indicated by the chain line arrow in FIG. 4.

Referring to the example shown in FIG. 4, the reflection absolute density D exceeds the threshold value Th at time points P1 and P2. In other words, a density variation amount A of the reflection absolute density D at the time points P1, P2 is large. The periodic unevenness detector 121 calculates the time difference (t) between the time points P2 and P1 as the period P in which the reflection absolute density D equal to or larger than the threshold value Th is detected, that is, the periodic unevenness period P. Alternatively, the periodic unevenness detector 121 may be configured to obtain the frequency (Hz) of the periodic unevenness based on the period P. The periodic unevenness detector 121 may also be configured to calculate the distance interval (mm) derived from converting the time distance between the time points P2 and P1 into the physical distance as the distance interval at which the periodic unevenness appears.

[Example of Causal Member Identifying Process Executed by Causal Member Identifying Section]

Figure 5:
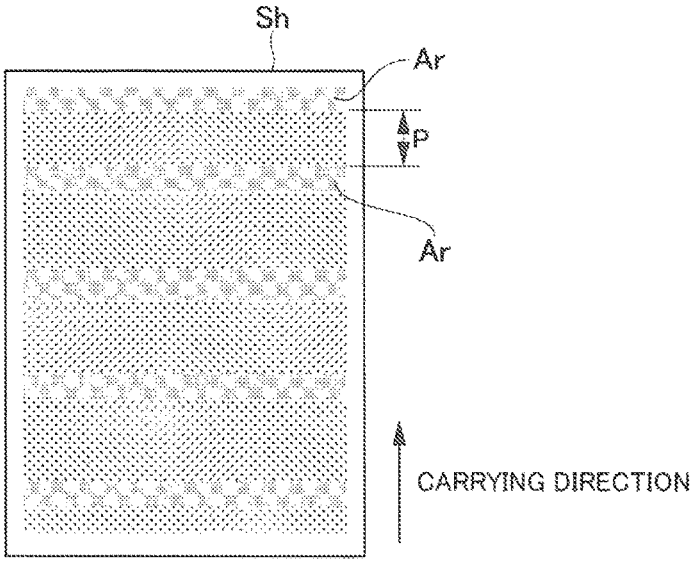
FIG. 5 is an explanatory view of an example of an image having the periodic unevenness according to an embodiment of the present invention.

An example of the causal member identifying process executed by the causal member identifying section 123 will be described referring to FIG. 5. FIG. 5 is an explanatory view showing an example of an image having the periodic unevenness. Referring to FIG. 5, the vertical direction denotes the direction for carrying the paper Sh, and the lateral direction denotes the width direction of the paper Sh. Referring to the paper Sh shown in FIG. 5, a high density region Ar repeatedly appears in the period P. In other words, the period P represents the periodic unevenness period. If the periodic unevenness period P coincides with the rotation period of the specific rotary member, the causal member identifying section 123 identifies the subject rotary member as the causal member of the periodic unevenness. Alternatively, the causal member identifying section 123 identifies the rotary member rotating at the same frequency as that of the periodic unevenness, or the rotary member with the same circumferential length as the distance interval at which the periodic unevenness appears as the causal member of the periodic unevenness.

Each process executed by the respective sections of the image forming apparatus 1 according to the embodiment, that is, the periodic unevenness detector 121, the causal member identifying section 123, the judgement section 124, the reset operation control section 125, and the life prolonging operation control section 126 will be described, taking specific cases (examples 1 and 2) as examples.

First Example (Outline of Process)

An explanation will be made with respect to the first example that the causal member of the transient periodic unevenness is the intermediate transfer belt 50. The image forming apparatus 1 of electrophotographic type may have the substance contained in the primary transfer roller 51 oozing out, that is, bleeding. The bled substance will adhere onto all over the rear surface of the intermediate transfer belt 50 in contact with the primary transfer roller 51. If the image forming apparatus 1 is left inoperative for a long time in the high temperature/high humidity environment as described above, the moisture absorption of the substance adhering onto the intermediate transfer belt 50 at the part in contact with the primary transfer roller 51 becomes different from the moisture absorption at the other part. Specifically, as the part in contact with the primary transfer roller 51 is not exposed to air, the moisture absorption of the substance will be made small. The moisture absorption of the substance at the other part exposed to air will be made large. The above-described moisture absorption difference becomes the resistance difference, thus causing the periodic unevenness on the image.

The periodic unevenness caused by the above-described intermediate transfer belt 50 may be restored by reset operation for making only the primary transfer roller 51 and the intermediate transfer belt 50 idle for a predetermined time period.

In the first example, if the causal member of the periodic unevenness is the intermediate transfer belt 50, the judgement section 124 (see FIG. 2) judges whether or not the periodic unevenness is transient. If the judgement section 124 judges that the periodic unevenness is possibly transient, the reset operation control section 125 executes the control for the reset operation as described above. If the periodic unevenness is eliminated by execution of the reset operation, the intermediate transfer belt 50 does not have to be replaced. This makes it possible to prevent unnecessary replacement of the member.

If the judgement section 124 judges that the periodic unevenness is not transient, or confirms that the periodic unevenness cannot be rectified in spite of execution of the reset operation, the life prolonging operation control section 126 executes the control for life prolonging operation to rectify the periodic unevenness. Specifically, the life prolonging operation control section 126 executes the control for the life prolonging operation to locate a periodic unevenness occurrence section between the papers. Execution of the life prolonging operation under the control of the life prolonging operation control section 126 allows the user to operate the image forming apparatus 1 for printing while waiting for the service personnel to come, suppressing generation of downtime.

(Detailed Process Executed by Each Section)

The detailed explanation will be made with respect to the process executed by each section according to the first example, that is, the periodic unevenness detector 121, the causal member identifying section 123, the judgement section 124, the reset operation control section 125, and the life prolonging operation control section 126.

1. Process for Detecting Periodic Unevenness

The periodic unevenness detector 121 judges that the periodic unevenness has occurred when detecting the region where the reflection absolute density D deviates from the threshold range, expressed as the "value (density) estimated from the image data in the range of ±0.1" in the printing area with the predetermined range where the density sensor 80 detects the density a predetermined number of times.

The printing area in the range where the periodic unevenness detector 121 detects the periodic unevenness may be set based on information of the circumferential length of the intermediate transfer belt 50 as the member with the longest circumferential length among the rotary members constituting the image forming apparatus 1, and the number of times of detection. If the circumferential length of the intermediate transfer belt 50 is set to 1,100 mm, and the region where the reflection absolute density D deviates from the threshold range is detected 5 times, for example, the printing area as the range for the periodic unevenness detection executed by the periodic unevenness detector 121 may be set using the following formula:

$$1{,}100\ (\text{mm}) \times 5(\text{times}) + \text{margin}\ \alpha(\text{mm}) = 6{,}600\ (\text{mm}).$$

The periodic unevenness detector 121 detects the region where the reflection absolute density D deviates from the threshold range with respect to one or more papers Sh in the printing area with upper limit of 6,600 (mm). If the above-described region is detected 5 times, it is judged that the periodic unevenness has occurred.

In order to judge whether the region where the reflection absolute density D deviates from the threshold range corresponds to the region having the periodic unevenness or the region having the periodic unevenness owing to any other cause, it is necessary to execute the detection at least 3 times. Therefore, the number of times of detection may be set to 3 or more predetermined times. The more the number of times of detection is set, the higher the accuracy of the periodic unevenness detection becomes. On the contrary, the less the number of times of detection is set, the faster the periodic unevenness may be detected.

2. Process for Identifying Member as a Cause of Periodic Unevenness

If the distance interval at which the periodic unevenness occurs is 1,100 mm as calculated by the periodic unevenness detector 121, the causal member identifying section 123 identifies the intermediate transfer belt 50 with circumferential length of 1,100 mm as the causal member of the periodic unevenness.

3. Process for Judging Transience of Periodic Unevenness

If the confirmation may be made that the image forming apparatus 1 has been left inoperative for several hours or more under the high temperature/high humidity environment referring to the information stored in the storage section 104, the judgement section 124 judges that the periodic unevenness detected by the periodic unevenness detector 121 is transient. The "high temperature/high humidity" represents that the temperature is 30° C. (example of the first temperature) or higher, and the humidity is 80% (example of the first humidity) or higher. They (temperature and humidity) may be set to appropriate values, respectively based on experiments and the like. The resting time may be set to the value corresponding to the time at which the moisture absorption of the substance adhering onto the intermediate transfer belt 50 owing to bleeding starts varying under the high temperature/high humidity environment, for example, 6 hours (example of the first time).

4. Process of Executing Control for Reset Operation

If the judgement section 124 judges that the periodic unevenness is transient, the reset operation control section 125 executes the control for reset operation by making only the primary transfer roller 51 and the intermediate transfer belt 50 idle for a predetermined time period. The time for making the primary transfer roller 51 and the intermediate transfer belt 50 idle may be set to the time period sufficient to equalize the moisture absorption of the substance adhering onto the intermediate transfer belt 50 owing to the bleeding, for example, 5 minutes.

5. Process of Re-Detecting Periodic Unevenness

After the control for reset operation, the reset operation control section 125 allows the periodic unevenness detector 121 to execute the periodic unevenness detection process again. If the periodic unevenness detector 121 detects the region where the reflection absolute density D deviates from the threshold range 5 times in the printing area with the upper limit of 6,600 mm, the reset operation control section 125 judges that restoration of the periodic unevenness has failed. On the contrary, if the number of times of detecting the region where the reflection absolute density D deviates from the threshold range is less than 5 times, the reset operation control section 125 judges that the restoration of the periodic unevenness has succeeded.

It is necessary to set the number of times of detecting the region where the reflection absolute density D deviates from the threshold range to at least 3 times so as to make sure the judgement that the reset operation control section 125 has failed to restore the periodic unevenness. Arbitrary number of times may be set so long as the set number is equal to or larger than 3.

6. Process of Controlling Execution of Life Prolonging Operation

If it is judged that the reset operation control section 125 has failed to restore the periodic unevenness, or the judgement section1 124 judges that the periodic unevenness is not transient, the life prolonging operation control section 126 allows the notification processing section 127 to output the service personnel call signal. Furthermore, the life prolonging operation control section 126 controls execution of the life prolonging operation.

The life prolonging operation control section 126 executes the control for life prolonging operation by locating the periodic unevenness occurrence position between the papers Sh.

Figure 6:
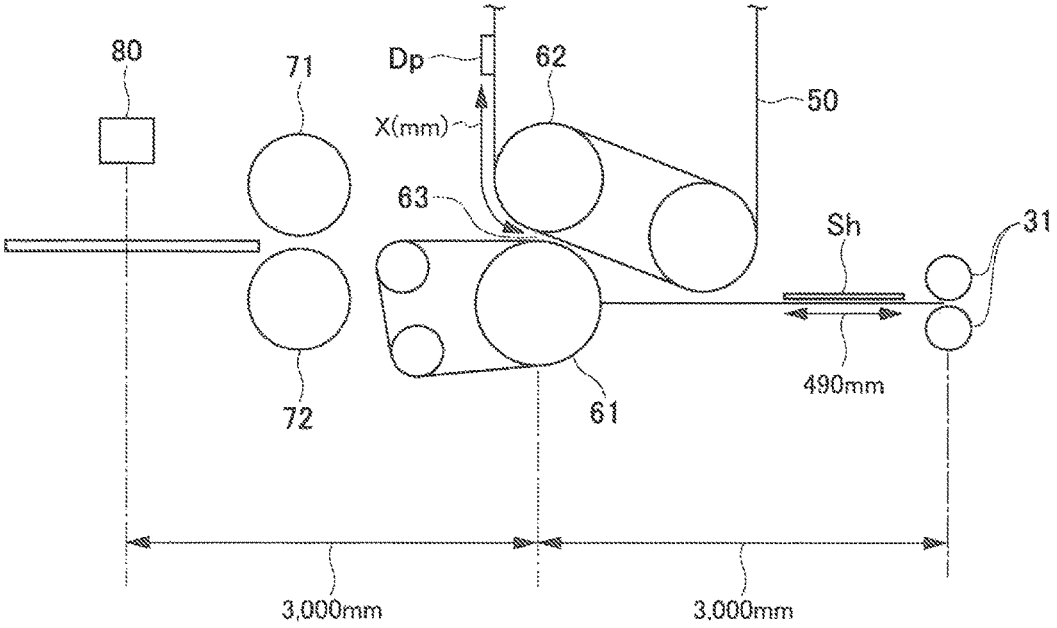
FIG. 6 is an explanatory view showing an example of parameters required to identify the defect position of an intermediate transfer belt according to an embodiment of the present invention.
Figure 7:
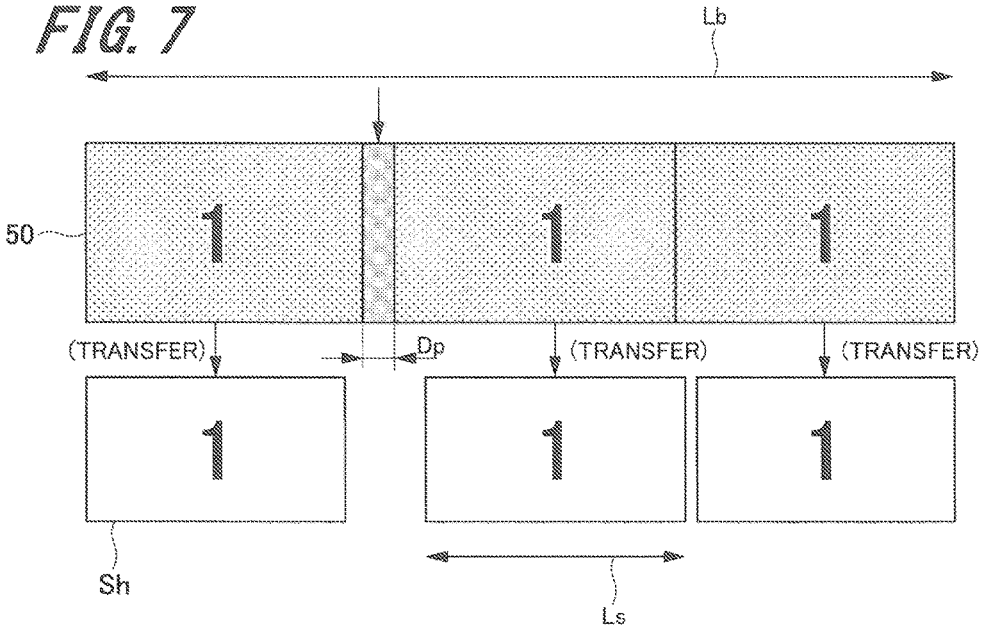
FIG. 7 is an explanatory view schematically showing a control for locating a periodic unevenness occurrence position between the papers according to an embodiment of the present invention.

Referring to FIGS. 6 and 7, an explanation will be made with respect to the specific example of the control executed by the life prolonging operation control section 126 for locating the periodic unevenness occurrence position between the papers. FIG. 6 is an explanatory view representing exemplary parameters required to identify the defect position of the intermediate transfer belt 50. FIG. 7 is an explanatory view schematically illustrating the control for locating the periodic unevenness occurrence position between the papers.

Referring to FIG. 6, an explanation will be made with respect to the process executed by the life prolonging operation control section 126 for identifying the defect position of the intermediate transfer belt 50. It is assumed that the paper Sh with length of 490 mm is carried at the linear velocity of 500 mm/s. It is further assumed that the paper carrier path length from the paper feed section 31 to the secondary transfer nip part 63 (transfer position) is set to 3,000 mm, and the paper carrier path length from the secondary transfer nip part 63 to the density sensor 80 is set to 3,000 mm.

In the above-described case, the calculated value of the time required for the leading end of the paper Sh that has been fed by the paper feed section 31 to reach the secondary transfer nip part 63 is 6 seconds. The calculated value of the time required for the rear end of the paper Sh that has been fed from the paper feed section 31 to reach the secondary transfer nip part 63 is 6.98 seconds.

A position with the defect (defect position) Dp as a cause of the density unevenness may be expressed as a position X (mm) advancing in the downstream direction from a reference point (0 mm) corresponding to the position of the secondary transfer nip part 63.

It is assumed that the defect position Dp on the intermediate transfer belt 50 upon detection of the periodic unevenness by the periodic unevenness detector 121 is at the location 800 mm downstream from the secondary transfer nip part 63 as the reference position. The distance "800 mm" may be calculated as the remainder of dividing the paper carrier path length of 3,000 mm from the secondary transfer nip part 63 to the density sensor 80 by 1,100 mm as the circumferential length of the intermediate transfer belt 50.

If the intermediate transfer belt 50 is moved for x seconds from the time point at which the defect position Dp is at the location 800 mm downstream of the secondary transfer nip part 63, the defect position Dp will move to the position corresponding to the remainder of dividing the x(s)×500 (mm/s)+800 (mm) by 1,100 (mm).

If the following condition 1 is satisfied upon printing on the next paper Sh, the defect position Dp is expected to be located on the paper Sh. Therefore, the life prolonging operation control section 126 controls so that the defect position Dp is located between the papers.

Defect position DpA(mm) at the time when the leading end of the paper Sh reaches the transfer position<1,100 (mm)<Defect position DpB(mm) at the time when the rear end of the paper Sh passes over the transfer position — Condition 1

The value "1,100" in the above-described condition 1 refers to the reference position to be used for indicating the defect position Dp. The reference position corresponds to the position of the secondary transfer nip part 63 as the transfer position. The reference position of the intermediate transfer belt 50 corresponds to either 0 mm or 1,100 mm. In the condition 1 as described above, the reference position will be expressed as "1,100" for convenience.

The defect position DpA in the condition 1 may be calculated as the remainder of dividing the solution of (time period for moving the intermediate transfer belt 50 before paper feeding+6 (s))×500 (mm/s)+800 (mm) by 1,100 (mm). The value "6" (s) in the condition 1 refers to the time taken for the leading end of the paper Sh that has been fed to reach the transfer position.

The defect position DpB may be calculated using the formula: (the remainder of dividing (time period for moving the intermediate transfer belt 50 before paper feeding+6 (s))×500 (mm/s)+800 (mm) by 1100 (mm))+0.98 (s)×500 (mm/s). The value "0.98" (s) in the condition 1 refers to the time derived from subtracting the time "6" (s) taken for the leading end of the paper Sh that has been fed to reach the transfer position from the time "6.98" (s) taken for the rear end of the paper Sh to reach the secondary transfer nip part 63. In other words, the value denotes the time elapsing from when the tip end of the paper Sh reaches the transfer position until the rear end of the paper Sh passes over the transfer position.

Specifically, if the "condition 1" is satisfied by establishing the relationship of "defect position DpA (mm)<1,100 (mm)<defect position DpB (mm)", the toner image on the defect position Dp of the intermediate transfer belt 50 will be transferred onto the paper Sh in the time elapsing from when the leading end of the paper Sh reaches the transfer position until the rear end passes over the transfer position. Therefore, the life prolonging operation control section 126 executes the control to locate the defect position Dp between the papers so that the toner image on the defect position Dp of the intermediate transfer belt 50 is not transferred onto the paper Sh.

The control to locate the defect position Dp between the papers may be executed only if the length of the paper Sh is shorter than the circumferential length of the intermediate transfer belt 50.

Referring to FIG. 7, an explanation will be made with respect to an exemplary control executed by the life prolonging operation control section 126 for locating the periodic unevenness occurrence position between the papers. The upper stage shown in FIG. 7 represents the state that the toner image of "1" is formed on the circumference of the intermediate transfer belt 50, and the lower stage shown in FIG. 7 represents the state that the toner image on the intermediate transfer belt 50 is transferred onto the paper Sh.

It is assumed that the single defect position Dp exists on the circumference of the intermediate transfer belt 50 with the circumferential length of Lp as indicated by the upper stage of FIG. 7. In this case, the life prolonging operation control section 126 stops operation (carrying operation of the paper Sh) of the member except the intermediate transfer belt 50, and rotates only the intermediate transfer belt 50 so that the defect position Dp is moved to the position where the condition 1 is not satisfied. Upon movement of the defect position Dp to the position at which the condition 1 is not satisfied, the life prolonging operation control section 126 starts printing again. At this time, the life prolonging operation control section 126 also executes the control not to form the toner image on the defect position Dp at which the periodic unevenness occurs. As the life prolonging operation control section 126 executes the control for life prolonging operation as described above, it is possible to prevent transfer of the toner image on the defect position Dp of the intermediate transfer belt 50 onto the paper Sh.

The life prolonging operation control section 126 executes the similar process (control) upon subsequent printing. In such an occasion, the defect position Dp ("800" in the above-described example) will be replaced with the value of the defect position Dp at the end of printing.

(Procedure of the Process Executed by Image Forming Apparatus)

Then the procedure of the process executed in the image forming apparatus 1 according to a first example will be described referring to FIG. 8. FIG. 8 is a flowchart representing the procedure of the process executed in the image forming apparatus 1 according to the first example.

The periodic unevenness detector 121 judges whether or not the periodic unevenness has been detected (step S1). If it is judged that the periodic unevenness has not been detected in step S1 (NO in step S1), the periodic unevenness detector 121 repeatedly executes the judgement in step S1.

If it is judged that the periodic unevenness has been detected in step S1 (YES in step S1), the causal member identifying section 123 judges whether or not the periodic unevenness causal member is the intermediate transfer belt 50 (step S2). If it is judged that the periodic unevenness causal member is not the intermediate transfer belt 50 (NO in step S2), the process to be executed in the first example ends.

Meanwhile, if it is judged that the periodic unevenness causal member is the intermediate transfer belt 50 (YES in step S2), the judgement section 124 judges whether or not the image forming apparatus 1 has been left inoperative for a long time under the high temperature/high humidity environment (step S3). If it is judged that the image forming apparatus 1 has been left inoperative for a long time under the high temperature/high humidity environment (YES in step S3), the judgement section 124 judges that the periodic unevenness is transient. Then the reset operation control section 125 executes the control for reset operation by making only the primary transfer roller 51 and the intermediate transfer belt 50 idle (step S4).

Then the reset operation control section 125 judges whether or not the periodic unevenness has been detected again (step S5). In step S5, the reset operation control section 125 allows the periodic unevenness detector 121 to detect the periodic unevenness again. If the periodic unevenness detector 121 detects the region where the reflection absolute density D deviates from the threshold range 5 times, it is judged that the periodic unevenness has been detected, that is, the periodic unevenness has not been restored yet. As the above-described "5 times" is a mere example, it is possible to set the arbitrary value so long as the number of times thought to be required for the periodic unevenness detection is 3 or more.

If it is judged in step S5 that the periodic unevenness has been detected again (YES in step S5), or it is judged in step S3 that the image forming apparatus 1 has not been left inoperative for a long time under the high temperature/high humidity environment (NO in step S3), the judgement section 124 judges that the periodic unevenness is not transient. Then the life prolonging operation control section 126 allows the notification processing section 127 to output the service personnel call signal, and executes the control for life prolonging operation by locating the periodic unevenness occurrence section (defect position Dp) between the papers (step S6). The process according to the first example then ends.

Meanwhile, if it is judged in step S5 that the periodic unevenness has not been detected again (NO in step S5), the life prolonging operation control section 126 returns the process to step S1.

Second Example (Outline of the Process)

An explanation will be made with respect to a second example in the case where the causal member of the transient periodic unevenness is the photoreceptor 41. The image forming apparatus 1 of electrophotographic type is configured to charge, expose, and destaticize the photoreceptor 41 when forming an image. If the charge on the photoreceptor 41 is not destaticized after formation of the image, the charge will remain on the photoreceptor 41. As a result, the image failure called "memory" will appear, that is, the past record image at the same cycle as the rotation period of the photoreceptor 41 is captured.

It is known that the memory appears resulting from the failure of the photoreceptor 41, or appears at the life end of the photoreceptor 41. The memory may also appear even if the photoreceptor 41 is new, and operated only in a short time, or in the case where the primary transfer roller 51 has high resistance resulting from the low temperature inside the image forming apparatus 1. If the memory is caused by the above-described factors, the periodic unevenness may be eliminated as the number of papers are printed repeatedly. That is, the periodic unevenness to be detected in the above-described environment (condition) may be regarded as the transient phenomenon.

In this case, the periodic unevenness reset operation is executed to restore the periodic unevenness by controlling to increase at least one of the charging current, the destaticizing light quantity, and the exposure amount of the photoreceptor 41 by 1.2 times, or controlling to correct density of the periodic unevenness. The "1.2 times" is a mere example, and an arbitrary value may be set so long as such a value secures the restoration of the periodic unevenness. In the second example, the reset operation control section 125 executes only one of control operations to increase at least one of the charging current, the destaticizing light quantity, and the exposure amount of the photoreceptor 41 by 1.2 times, and to correct density of the periodic unevenness so that the periodic unevenness is restored. However, the reset operation control section 125 may be configured to execute both the control operations as described above for reset operation without limitation.

In the second example, if the periodic unevenness causal member is the photoreceptor 41, the judgement section 124 (see FIG. 2) judges whether or not the periodic unevenness is transient. If it is judged by the judgement section 124 that the periodic unevenness is transient, the reset operation control section 125 executes the control for reset operation as described above. If the periodic unevenness is eliminated by executing the reset operation, the photoreceptor 41 does not have to be replaced, suppressing unnecessary replacement of the member.

Meanwhile, if the judgement section 124 judges that the periodic unevenness is not transient, or the periodic unevenness cannot be rectified in spite of execution of the reset operation, the life prolonging operation control section 126 executes the control for life prolonging operation so as to rectify the periodic unevenness. Specifically, the life prolonging operation control section 126 executes the control for life prolonging operation in the manner similar to the reset operation. That is, the section executes the control for increasing at least one of the charging current, the destaticizing light quantity, and the exposure amount of the photoreceptor 41 by 1.2 times, and/or correcting the periodic unevenness density. As the above-described life prolonging operation is executed under the control of the life prolonging operation control section 126, the user is allowed to perform printing operation using the image processing apparatus 1 while waiting for the service personnel to come, thus suppressing generation of the downtime.

(Detailed Process Executed by the Respective Sections)

In the second example, each process executed by the periodic unevenness detector 121, the causal member identifying section 123, the judgement section 124, the reset operation control section 125, and the life prolonging operation control section 126 according to the second embodiment will be described in detail.

1. Periodic Unevenness Detection Process

Upon detection of the region where the reflection absolute density D deviates from the threshold range expressed by "the value (density) estimated from the image data in the range of ±0.1" in the printing area with the predetermined range where the density sensor 80 detects the density predetermined number of times, the periodic unevenness detector 121 judges that the periodic unevenness has occurred. That is, the process similar to the one as described in the first example will be executed.

2. Process of Identifying Periodic Unevenness Causal Member

Assuming that the distance interval at which the periodic unevenness occurs, which has been calculated by the periodic unevenness detector 121 is 250 mm, for example, the causal member identifying section 123 identifies the photoreceptor 41 with the circumferential length of 250 mm as the periodic unevenness causal member.

3. Process of Judging Transience of Periodic Unevenness

If at least one of the first to the third conditions to be described below is satisfied, the judgement section 124 judges that the periodic unevenness owing to the photoreceptor 41 is transient.

(First condition) The temperature in the image forming apparatus 1 is 10° C. (example of the second temperature) or lower, and the humidity is 30% (example of the second humidity) or lower.

(Second condition) The operating time (total operating time) of the photoreceptor 41 is 30,000 s (example of the second time) or less.

(Third condition) The primary transfer voltage is 800 V (example of the first voltage) or higher.

4. Process of Controlling for Reset Operation

If the judgement section 124 judges that the periodic unevenness is transient, the reset operation control section 125 executes the control for reset operation by increasing at least one of the charging current, the destaticizing light quantity, and the exposure amount of the photoreceptor 41 by 1.2 times in the time elapsing from detection of the periodic unevenness until the number of subsequent printed papers reaches 5,000. Alternatively, the reset operation control section 125 executes the control for reset operation by correcting the periodic unevenness density in the time elapsing from detection of the periodic unevenness until the number of subsequent printed papers reaches 5,000. Specifically, the density variation amount at the point where the density varies relative to the one estimated from the original image data, in other words, at the point where the periodic unevenness occurs may be added to the image data as modification for adjustment to the normal density.

The "30,000 s" set as the total operating time of the photoreceptor 41 is a mere example, and may be set to an arbitrary value so long as such a value has the potential for rectifying the transient periodic unevenness owing to the photoreceptor 41.

The "5,000 sheets" set as the number of printed papers is also a mere example, and may be set to an arbitrary value so long as such a value is thought to be necessary for achieving the time with the potential for rectifying the transient periodic unevenness owing to the photoreceptor 41.

5. Process of Re-Detecting Periodic Unevenness

The reset operation control section 125 allows the periodic unevenness detector 121 to execute the periodic unevenness detection again after controlling the reset operation. If the periodic unevenness detector 121 detects the periodic unevenness again, the reset operation control section 125 judges that the reset operation has failed to restore the periodic unevenness. If the periodic unevenness detector 121 does not detect the periodic unevenness, the reset operation control section 125 judges that the reset operation has succeeded in restoration of the periodic unevenness. The periodic unevenness detector 121 executes the process for re-detecting the periodic unevenness in the manner similar to the one executed in the first embodiment.

6. Process of Controlling for Life Prolonging Operation

If it is judged that the reset operation control section 125 has failed to restore the periodic unevenness, or the judgement section 124 judges that the periodic unevenness is not transient, the life prolonging operation control section 126 allows the notification processing section 127 to output the service personnel call signal. Furthermore, the life prolonging operation control section 126 executes the control for life prolonging operation.

The life prolonging operation control section 126 executes the control for life prolonging operation in the manner similar to the reset operation until replacement of the photoreceptor 41. In other words, the control operation is executed to increase at least one of the charging light quantity, the destaticizing light quantity, and the exposure amount of the photoreceptor 41 by 1.2 times, or correct the periodic unevenness density.

(Procedure of the Process Executed in Image Forming Apparatus)

The procedure of the process executed in the image forming apparatus 1 according to the second example will be described referring to FIG. 9. FIG. 9 is a flowchart representing the procedure of the process executed in the image forming apparatus 1 according to the second example.

The periodic unevenness detector 121 judges whether or not the periodic unevenness has been detected (step S11). If it is judged in step S11 that the periodic unevenness has not been detected (NO in step S11), the periodic unevenness detector 121 executes the judgement in step S11 repeatedly.

Meanwhile, if it is judged in step S11 that the periodic unevenness has been detected (YES in step S11), the causal member identifying section 123 judges whether or not the periodic unevenness causal member is the photoreceptor 41 (step S12). If it is judged that the periodic unevenness causal member is not the photoreceptor 41 in step S12 (NO in step S12), the process in the second example ends.

Meanwhile, if it is judged in step S12 that the periodic unevenness causal member is the photoreceptor 41 (YES in step S12), the judgement section 124 judges whether the total operating time of the photoreceptor is equal to or smaller than the specified value, whether the primary transfer voltage is equal to or larger than the specified value, or whether the operation is executed at a low temperature/low humidity environment (step S13).

If at least one of the judgements executed in step S13 results in YES (YES in step S13), the judgement section 124 judges that the periodic unevenness is transient. The reset operation control section 125 executes the control for reset operation by temporarily increasing either the destaticizing light quantity or exposure amount, or temporarily correcting the periodic unevenness density (step S14).

The reset operation control section 125 then judges whether or not the periodic unevenness has been detected again (step S15). The reset operation control section 125 judges whether or not the periodic unevenness has been detected again in the manner similar to the first example.

If it is judged in step S15 that the periodic unevenness has been detected again (YES in step S15), or in step S13 that none of the conditions has been satisfied (NO in step S13), the judgement section 124 judges that the periodic unevenness is not transient. The life prolonging operation control section 126 allows the notification processing section 127 to output the service personnel call signal, and executes the control for life prolonging operation by increasing either the destaticizing light quantity or the exposure amount, or by correcting the periodic unevenness density during replacement of the photoreceptor (step S16). The process in the second embodiment then ends.

If it is judged in step S15 that the periodic unevenness has not been detected again (NO in step S15), the reset operation control section 125 returns the process to step S11.

<Various Effects>

In the embodiment including the first and the second examples as described above, in response to detection of the periodic unevenness caused by the specific causal member, the judgement section 124 judges whether or not the periodic unevenness is transient based on the information of at least one of the resting time in which the image forming apparatus 1 has been left inoperative, the operating time of the causal member, and the image forming condition for forming the image, and the information of temperature and humidity inside the image forming apparatus. In other words, upon detection of the periodic unevenness caused by the specific causal member, the embodiment ensures to confirm transience of the detected periodic unevenness so as to prevent output of the error or the service personnel call signal. Therefore, the embodiment ensures to prevent unnecessary replacement of the member that needs not be wasted.

In the first example, assuming that the causal member identified by the causal member identifying section 123 is the intermediate transfer belt 50, the judgement section 124 will judge that the periodic unevenness is transient in the case of high temperature, for example, 30° C., and high humidity, for example, 80% inside the image forming apparatus 1, and the long resting time of the image forming apparatus 1, for example, 6 hours. Accordingly, the embodiment ensures to appropriately judge as to transience of the periodic unevenness owing to the intermediate transfer belt 50 as the causal member identified by the causal member identification section 123 based on the information of temperature and humidity inside the image forming apparatus 1, and the information of the resting time of the image forming apparatus 1.

In the above-described second example, assuming that the causal member identifying section 123 identifies the photoreceptor 41 as the causal member, the judgement section 124 judges that the periodic unevenness is transient if at least one of the first to the third conditions to be described later is satisfied.

(First condition) The temperature inside the image forming apparatus 1 is low, for example, 10° C. or lower, and the humidity inside the image forming apparatus 1 is low, for example, 30% or lower.

(Second condition) The total operating time of the photoreceptor 41 is short, for example, 30,000 s or less.

(Third condition) The primary transfer voltage is high, for example, 800 V or higher.

Accordingly, the embodiment ensures to appropriately judge as to transience of the periodic unevenness owing to the photoreceptor 41 as the causal member identified by the causal member identification section 123 based on the information of temperature and humidity inside the image forming apparatus 1, and the information of the resting time of the image forming apparatus 1.

In the first example as described above, if the intermediate transfer belt 50 is identified as the causal member by the causal member identifying section 123, the reset operation control section 125 executes the control for reset operation by making the intermediate transfer belt 50 idle for a predetermined time. The above-described reset operation uniformizes the moisture absorption of the substance adhering over the entire back surface of the intermediate transfer belt 50 owing to bleeding so that the periodic unevenness is eliminated. Therefore, the embodiment ensures to prevent unnecessary replacement of the member that needs not be wasted.

In the second example as described above, if the photoreceptor 41 is identified as the causal member by the causal member identifying section 123, the reset operation control section 125 executes the control for reset operation by temporarily increasing at least one of the charging current, the destaticizing light quantity, and the exposure amount of the photoreceptor 41. Alternatively, the reset operation control section 125 executes the control by temporarily correcting the density of the toner image at the position where the periodic unevenness occurs, which has been detected by the periodic unevenness detector 121. Execution of the reset operations as described above eliminates the transient periodic unevenness caused by the short total operating time of the photoreceptor 41, or the high resistance of the primary transfer roller 51 at the low temperature. Therefore, the embodiment ensures to prevent unnecessary replacement of the member that needs not be wasted.

In the first example as described above, if the intermediate transfer belt 50 is identified as the causal member by the causal member identifying section 123, and the length of the paper Sh is longer than the circumferential length of the intermediate transfer belt 50, the life prolonging operation control section 126 performs the life prolonging operation. Specifically, the life prolonging operation control section 126 controls operations of driving the intermediate transfer belt 50, and carrying the paper Sh so that the periodic unevenness occurrence position is located between the papers upon transfer of the image onto the paper Sh. In the embodiment, the image at the periodic unevenness occurrence position is not transferred onto the paper Sh. Therefore, the image forming apparatus 1 may be continuously operated while the intermediate transfer belt 50 is replaced by the service personnel. Accordingly, the embodiment ensures to prevent generation of the downtime which interferes with the operation of the image forming apparatus 1.

In the second example as described above, if the photoreceptor 41 is identified as the causal member by the causal member identifying section 123, the life prolonging operation control section 126 executes the control for life prolonging operation by increasing at least one of the charging current, the destaticizing light quantity, and the exposure amount of the photoreceptor 41 during replacement of the photoreceptor 41. Alternatively, the life prolonging operation control section 126 executes the control by correcting the density of the toner image at the periodic unevenness occurrence position, which has been detected by the periodic unevenness detector 121. Execution of the above-described life prolonging operation allows rectification of the periodic unevenness caused by the memory on the photoreceptor 41. Therefore, the image forming apparatus 1 may be continuously operated while the photoreceptor 41 is replaced by the service personnel. Accordingly, the embodiment ensures to prevent generation of the downtime which interferes with the operation of the image forming apparatus 1.

<Various Modifications>

The present invention is not limited to the embodiment (first and second examples) as described above. It is to be understood that the invention is arbitrarily applicable and modifiable so long as there is no deviation from the scope of the present invention. For example, the following modified examples may be contained in the present invention.

In the embodiment (first and second examples) as described above, if the judgement section 124 judges that the periodic unevenness detected by the periodic unevenness detector 121 is transient, the reset operation control section 125 always executes the control for reset operation. The present invention, however, is not limited to the one as described above. It is also possible to inhibit the reset operation control section 125 from executing the control for reset operation in response to the judgement of the judgement section 124 that the periodic unevenness is transient. The above-described configuration is achievable as there may be the case that the periodic unevenness is naturally rectified depending on the operation state of the image forming apparatus 1 without executing the control purposely for rectifying the periodic unevenness.

In the embodiment as described above, the periodic unevenness detector 121 uses the threshold value for detecting the density unevenness, expressed as the "value (density) in the range of ±0.1, based on which the reflection absolute density D is estimated from the image data". However, the present invention is not limited to the one as described above. For example, it is possible to use the threshold value, expressed as the "reflection absolute density in the range of ±0.1, which has been measured and recorded immediately after replacement of the component (intermediate transfer belt 50)". Even if the density to be detected by the density sensor 80 originally deviates from the value estimated from the image data, the periodic unevenness detector 121 is capable of appropriately detecting the periodic unevenness.

Immediately after replacement of the component, the density sensor 80 measures the reflection absolute density D at the frequency corresponding to the rotation period of the component. The information of the periodic reflection absolute density D measured by the density sensor 80 may be recorded in a density recorder (not shown) disposed in the storage section 104.

The embodiment describes the cases in which the causal member of the transient periodic unevenness is the intermediate transfer belt 50 (first example), or the photoreceptor 41 (second example). The present invention is not limited to the cases having the above-described causal members exemplified.

For example, if the image forming apparatus 1 has been left inoperative for a long time of 6 hours or the like under the low temperature environment at 10° C. or less, the primary transfer roller 51 is cooled to increase its resistance, which may intensify the resistance unevenness, resulting in the transient periodic unevenness. Accordingly, if the primary transfer roller 51 is the causal member of the periodic unevenness, the judgement section 124 is capable of judging whether or not the periodic unevenness is transient based on the information of the internal temperature of the image forming apparatus 1 and the resting time.

If the primary transfer roller 51 is the causal member of the periodic unevenness, and the periodic unevenness is transient, the reset operation control section 125 raises the temperature of a fixing upper roller 71 to 200° C., for example (an example of the third temperature), and rotates the fixing upper roller 71 for a predetermined time, for example, 20 minutes so that the periodic unevenness is restored. As the temperature of the fixing upper roller 71 is raised to be high, and the roller is rotated for the predetermined time period, the internal temperature of the image forming apparatus 1 may be increased, and the resistance of the primary transfer roller 51 is reduced correspondingly.

The reset operation control section 125 is capable of restoring the transient periodic unevenness even in the case of double-face printing of approximately 100 sheets of A3-size paper Sh in the normal printing operation.

If a fixing belt (not shown) is used as the member of the fixing section 70 in addition to the fixing upper roller 71 and the fixing lower roller 72, the periodic unevenness may possibly be caused by the flaw on the belt due to external factors. For example, jamming removing process (for removing the jammed paper) may be the external factor. If the fixing belt is the causal member of the periodic unevenness, the judgement section 124 is capable of judging whether or not the periodic unevenness is transient based on the information indicating whether or not the jamming removing process has been executed.

If the fixing belt is the causal member of the periodic unevenness, and the periodic unevenness is transient, the reset operation control section 125 raises the temperature of the fixing belt to be high (temperature to be set for printing), and makes the belt idle for the predetermined time, for example, 10 to 20 minutes so that the transient periodic unevenness is restored. If the flaw on the fixing belt is shallow, the above-described process may be executed to allow restoration of the periodic unevenness.

In the embodiment as described above, only one causal member of the periodic unevenness is presumed as being identified by the causal member identifying section 123. The present invention is not limited to the one as described above. In the case of a plurality of rotary members each at the cycle (frequency or distance interval) corresponding to that of the periodic unevenness (frequency or distance interval), the causal member identifying section 123 preferentially judges that the function member is the causal member. The function member is the one that influences the quality of the image on the printed matter highly possibly as described above, for example, the developing roller **44*r*, the photoreceptor 41, the intermediate transfer belt 50, the primary transfer roller 51, the secondary transfer roller 61, the secondary transfer counter roller 62, the secondary transfer belt (not shown), the fixing upper roller 71 and the fixing lower roller 72**.

Among the above-described function members, there are 4 developing rollers **44*r*, 4 photoreceptors 41, and 4 primary transfer rollers 51, each corresponding to the respective colors of Y, M, C, K. Accordingly, based on the information of the color at which the periodic unevenness has occurred, the causal member identifying section 123** is capable of identifying the specific one of those 4 rotary members as the causal member.

In the case of a plurality of rotary members each with the cycle (frequency or distance interval) corresponding to that of the periodic unevenness (frequency or distance interval), the causal member identifying section 123 may be configured to identify the causal member by executing a series of following steps (a) to (e) for each member.

(a) The judgement section 124 judges whether or not the periodic unevenness is transient.

(b) The reset operation control section 125 executes the control for reset operation.

(c) The reset operation control section 125 re-detects the periodic unevenness (re-confirmation).

(d) The life prolonging operation control section 126 executes the control for life prolonging operation.

(e) The normal printing is performed.

In the normal printing performed in step (e), at a time point when rectification (or elimination) of the periodic unevenness is recognized, the rotary member that has been subjected to the control for life prolonging operation in the previous step (d) may be identified as the causal member of the transient periodic unevenness. Once the causal member of the transient periodic unevenness is identified, the reset operation will be no longer performed by the reset operation control section 125, and the life prolonging operation will also be no longer performed by the life prolonging operation control section 126.

Although embodiments of the present invention have been described and illustrated in detail, the disclosed embodiments are made for purposes of illustration and example only and not limitation. The scope of the present invention should be interpreted by terms of the appended claims.

REFERENCE SIGNS LIST

1 image forming apparatus
31 paper feed section
32 carrier section
41 photoreceptor
42 charging part
43 exposure part
44*r* developing roller
44 developing part
45 cleaning part
46 destaticizing part
50 intermediate transfer belt
51 primary transfer roller
60 secondary transfer section
61 secondary transfer roller
62 secondary transfer counter roller
63 secondary transfer nip part
70 fixing section
71 upper fixing roller
72 lower fixing roller
73 fixing nip part
80 density sensor
90 thermometer/hygrometer
100 controller
104 storage section
104*a* temperature/humidity information holding unit
104*b* operating time information holding unit
104*c* resting time information holding unit
104*d* image forming condition information holding unit
105 operation display section
106 communication section
120 image processor
121 periodic unevenness detector
122 operative/inoperative time measurement section
123 causal member identifying section
124 judgement section
125 reset operation control section
126 life prolonging operation control section
127 notification processing section

What is claimed is:

1. An image forming apparatus comprising:

a density sensor which measures a density of an image formed on a paper or a toner deposition amount, and outputs a measured value;

a periodic unevenness detector which detects a periodic unevenness as a density unevenness which periodically appears on the image in a carrying direction of the paper, and calculates a period of the periodic unevenness based on the image density or the toner deposition amount output from the density sensor;

a causal member identifying section which identifies a causal member as a cause of the periodic unevenness based on the period of the periodic unevenness detected by the periodic unevenness detector; and a judgement section which judges whether or not the periodic unevenness is transient based on information of the causal member identified by the causal member identifying section, information of at least one of a resting time in which the image forming apparatus has been left inoperative, an operating time of the causal member, and an image forming condition for forming the image, and information of a temperature and a humidity inside the image forming apparatus.

2. The image forming apparatus according to claim 1, further comprising:

a photoreceptor as an image carrier; and an intermediate transfer belt which transfers a toner image deposited on the photoreceptor onto the paper, wherein in a state where the causal member identified by the causal member identifying section is the intermediate transfer belt, in a case of a high temperature inside the image forming apparatus, which is equal to or higher than a first temperature, a high humidity inside the image forming apparatus, which is equal to or higher than a first humidity, and a long resting time which is equal to or longer than a first time, the judgement section judges that the periodic unevenness caused by the intermediate transfer belt is transient.

3. The image forming apparatus according to claim 2, further comprising a reset operation control section which controls a reset operation for restoring the periodic unevenness detected by the periodic unevenness detector, which has been judged as being transient by the judgement section, wherein in a state where the causal member identified by the causal member identifying section is the intermediate transfer belt, the reset operation control section executes a control for the reset operation by making the intermediate transfer belt idle for a predetermined time.

4. The image forming apparatus according to claim 3, further comprising a life prolonging operation control section which controls an output of a service personnel call signal, and a life prolonging operation for rectifying the periodic unevenness if the judgement section judges that the periodic unevenness detected by the periodic unevenness detector is not transient, or the periodic unevenness is not restored even after the reset operation performed under the control of the reset operation control section, wherein if the causal member identified by the causal member identifying section is the intermediate transfer belt, and a length of the paper is longer than a circumferential length of the intermediate transfer belt, the life prolonging operation control section controls operations for the life prolonging operation by driving the intermediate transfer belt and carrying the paper so that a position at which the periodic unevenness occurs is located between the papers when transferring the image onto the paper for the life prolonging operation.

5. The image forming apparatus according to claim 1, further comprising:

a photoreceptor as an image carrier;

an intermediate transfer belt which transfers a toner image deposited on the photoreceptor onto the paper; and a primary transfer roller which transfers the toner image formed on the photoreceptor onto the intermediate transfer belt by applying a primary transfer voltage with polarity opposite to a polarity of the toner to the intermediate transfer belt, wherein in a state where the causal member identified by the causal member identifying section is the photoreceptor, the judgement section judges that the periodic unevenness caused by the photoreceptor is transient if at least one of conditions is satisfied, the conditions including a first condition that the temperature inside the image forming apparatus is low, which is equal to or lower than a second temperature, and the humidity inside the image forming apparatus is low, which is equal to or lower than a second humidity, a second condition that the operating time of the photoreceptor is short, which is equal to or shorter than a second time, and a third condition that the primary transfer voltage of the primary transfer roller is high, which is equal to or higher than a first voltage as the image forming condition.

6. The image forming apparatus according to claim 5, further comprising a reset operation control section which controls a reset operation for restoring the periodic unevenness detected by the periodic unevenness detector, which has been judged as being transient by the judgement section, wherein in the state where the causal member identified by the causal member identifying section is the photoreceptor, the reset operation control section executes a control for the reset operation by temporarily increasing at least one of charging current, destaticizing light quantity, and exposure amount of the photoreceptor.

7. The image forming apparatus according to claim 6, further comprising a life prolonging operation control section which controls an output of a service personnel call signal, and a life prolonging operation for rectifying the periodic unevenness if the judgement section judges that the periodic unevenness detected by the periodic unevenness detector is not transient, or the periodic unevenness is not restored even after the reset operation performed under the control of the reset operation control section, wherein if the causal member identified by the causal member identifying section is the photoreceptor, the life prolonging operation control section executes the control for the life prolonging operation by increasing at least one of charging current, destaticizing light quantity, and exposure amount of the photoreceptor during replacement of the photoreceptor.

8. The image forming apparatus according to claim 6, further comprising a life prolonging operation control section which controls an output of a service personnel call signal, and a life prolonging operation for rectifying the periodic unevenness if the judgement section judges that the periodic unevenness detected by the periodic unevenness detector is not transient, or the periodic unevenness is not restored even after the reset operation performed under the control of the reset operation control section, wherein if the causal member identified by the causal member identifying section is the photoreceptor, the life prolonging operation control section executes the control for the life prolonging operation by correcting the density of the toner image at a position at which the periodic unevenness occurs, which has been detected by the periodic unevenness detector during replacement of the photoreceptor.

9. The image forming apparatus according to claim 5, further comprising a reset operation control section which controls a reset operation for restoring the periodic unevenness detected by the periodic unevenness detector, which has been judged as being transient by the judgement section, wherein in the state where the causal member identified by the causal member identifying section is the photoreceptor, the reset operation control section executes a control for the reset operation by temporarily correcting the density of the toner image at a periodic unevenness occurrence position, which has been detected by the periodic unevenness detector.

10. The image forming apparatus according to claim 1, further comprising:

a photoreceptor as an image carrier;

an intermediate transfer belt for transferring a toner image deposited on the photoreceptor onto the paper; and a primary transfer roller which transfers the toner image formed on the photoreceptor onto the intermediate transfer belt by applying a primary transfer voltage with polarity opposite to a polarity of the toner to the intermediate transfer belt, wherein in a state where the causal member identified by the causal member identifying section is the primary transfer roller, in a case of a low temperature inside the image forming apparatus, which is equal to or lower than a second temperature, and a long resting time which is equal to or longer than a first time, the judgement section judges that the periodic unevenness caused by the primary transfer roller is transient.

11. The image forming apparatus according to claim 10, further comprising:

a fixing section which fixes the image transferred onto the paper by heating and pressurizing the paper onto which the toner image has been transferred by the intermediate transfer belt; and a reset operation control section which controls a reset operation for restoring the periodic unevenness detected by the periodic unevenness detector, which has been judged as being transient by the judgement section, wherein in the state where the causal member identified by the causal member identifying section is the primary transfer roller, the reset operation control section executes the control for the reset operation by setting the temperature of a fixing roller that constitutes the fixing section to a third temperature indicating a high temperature, and rotating the fixing roller for a predetermined time.

* * * * *